US006201506B1

(12) United States Patent
Endo et al.

(10) Patent No.: US 6,201,506 B1
(45) Date of Patent: Mar. 13, 2001

(54) VEHICLE WINDOWPANE ANTENNA APPARATUS

(75) Inventors: Hiroshi Endo, Tokyo (JP); Richard Langley, Chartham Hatch (GB)

(73) Assignee: Harada Industry Co., Ltd. (JP)

( * ) Notice: Subject to any disclaimer, the term of this patent is extended or adjusted under 35 U.S.C. 154(b) by 0 days.

(21) Appl. No.: 09/461,128

(22) Filed: Dec. 14, 1999

(30) Foreign Application Priority Data

Dec. 14, 1998 (JP) ..... 10-354696

(51) Int. Cl.[7] ..... H01Q 1/32
(52) U.S. Cl. ..... 343/713; 343/704
(58) Field of Search ..... 343/704, 713

(56) References Cited

U.S. PATENT DOCUMENTS

| | | | | |
|---|---|---|---|---|
| 5,097,270 | | 3/1992 | Flachenecker et al. | 343/704 |
| 5,654,720 | | 8/1997 | Saitou et al. | 343/713 |
| 5,659,324 | * | 8/1997 | Taniguchi et al. | 343/713 |
| 5,933,119 | * | 8/1999 | Fujii et al. | 343/713 |
| 5,952,977 | * | 9/1999 | Taniguchi et al. | 343/713 |
| 5,959,587 | * | 9/1999 | McHenry et al. | 343/713 |

FOREIGN PATENT DOCUMENTS

| | | |
|---|---|---|
| 0 661 772 | 7/1995 | (EP) . |
| 0 856 904 | 8/1998 | (EP) . |

* cited by examiner

*Primary Examiner*—Tan Ho
(74) *Attorney, Agent, or Firm*—Pennie & Edmonds LLP

(57) ABSTRACT

A vehicle windowpane antenna apparatus comprises a defogger for defogging a vehicle window, which is constituted of strip conductor at least including a plurality of horizontal wires and a pair of bus bars, the bus bars being arranged on a window glass surface and each opposed to a metal section of a window frame with a bus-bar gap therebetween, a unit for separating the power source line and the defogger from each other in a high-frequency manner, vertical wires crossing the horizontal wires to form the defogger in a mesh pattern having meshes, a length of a longer side of each of the meshes being smaller than a wavelength of received wave, and a driven antenna having a height and provided close and opposite to the defogger with a clearance therebetween in such a manner that one side of the driven antenna is mutually coupled to one side of the defogger, the bus-bar gap being set to 50 mm to 70 mm, the clearance being set to 5 mm to 15 mm, the height of the driven antenna being set to 100 mm to 250 mm, the number of vertical wires being one or more, and the power source line and the bus bars constitute an open circuit therebetween.

3 Claims, 5 Drawing Sheets

VEHICLE WINDOWPANE ANTENNA APPARATUS

BACKGROUND OF THE INVENTION

The present invention relates to a vehicle windowpane antenna apparatus which is mounted on a window of a vehicle such as an automobile.

There is an automobile windowpane antenna apparatus as the most typical one of prior art vehicle windowpane antenna apparatuses. This type of antenna apparatus includes a thin, narrow, strip conductor mounted on a window (usually a rear window) of an automobile, which is employed as an antenna.

In recent automobiles, a defogger is provided almost all over the rear window to serve as a heater for defogging the window. The antenna therefore has to be mounted in a limited space between the defogger and the window frame.

The above prior art automobile windowpane antenna apparatus has the problem that its reception sensitivity cannot be obtained sufficiently in the AM or FM band since a space for mounting the antenna is limited. The apparatus also has the problem that an adjustment for the shape and arrangement of the antenna makes tuning for optimizing the reception performance difficult and a long period of time is required for performing the tuning operation.

In order to resolve the above problems, the present inventors have developed the following vehicle windowpane antenna apparatus and filed it as Japanese Patent Application No. 10-282870 (its corresponding U.S. and EPC applications have been filed). The antenna apparatus comprises a defogger mounted on a vehicle window, for defogging the window, a means for causing the defogger to serve as a slot antenna, and a driven antenna arranged close and opposite to the defogger with a given gap therebetween in such a manner that one side of the driven antenna is mutually coupled to one side of the defogger.

The foregoing vehicle windowpane antenna apparatus has the advantages that its reception sensitivity is high across a wide band and its tuning operation is easy to perform. However, it has the following problem to be solved. When the antenna apparatus is mounted on a rear window of an automobile, it is unclear how to set the dimensions of respective antenna sections and how to arrange these sections in order to obtain the optimum antenna characteristics. It is thus likely that a required antenna characteristic will not be obtained reliably according to the circumstances.

BRIEF SUMMARY OF THE INVENTION

Accordingly, the object of the present invention is to provide a vehicle windowpane antenna apparatus which has the advantages that its reception sensitivity is high across a wide band and its tuning operation is easy and which is capable of being mounted appropriately on a rear window of an automobile to constantly obtain a required antenna characteristic.

To attain the above object, a vehicle windowpane antenna apparatus according to the present invention has the following features in constitution. The other features will be clarified later in the Description of the Invention.

A vehicle windowpane antenna apparatus comprising:

a defogger for defogging a vehicle window, which is constituted of a thin, narrow strip conductor and includes a plurality of horizontal wires arranged at least in parallel with each other and a pair of bus bars each connected in common to ends of the horizontal wires, the bus bars being arranged on a window glass surface of the vehicle window and each opposed to a metal section of a window frame of the vehicle window with a bus-bar gap therebetween;

a power source line for applying a power to the defogger;

means for separating the power source line and the defogger from each other in a high-frequency manner;

vertical wires crossing the horizontal wires to form the defogger in a mesh pattern having meshes, a length of a longer side of each of the meshes being smaller than a wavelength of received wave; and a driven antenna having a height and provided close and opposite to the defogger with a clearance therebetween in such a manner that one side of the driven antenna is mutually coupled to one side of the defogger, the bus-bar gap being set to 50 mm to 70 mm, the clearance being set to 5 mm to 15 mm, the height of the driven antenna being set to 100 mm to 250 mm, the number of vertical wires being one or more, and the power source line and the bus bars constitute an open circuit therebetween.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiment

Figure 1:
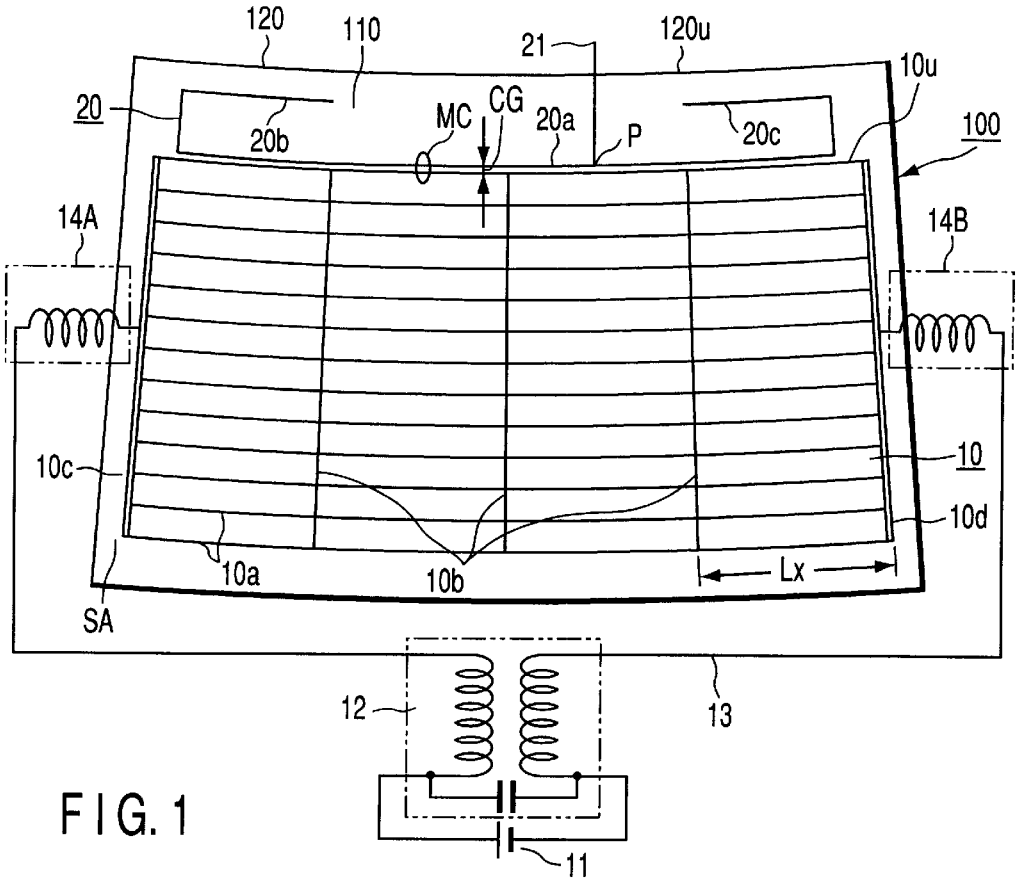
FIG. 1 is a view of the constitution of a vehicle windowpane antenna apparatus according to an embodiment of the present invention.

FIG. 1 illustrates the constitution of a vehicle (automobile) windowpane antenna apparatus according to an embodiment of the present invention. As shown in FIG. 1, a defogger 10 is formed almost all over a window glass surface 110 of a rear window 100 of a vehicle (e.g., an automobile) to serve as a heater for defogging the window.

The defogger 10 includes a plurality of horizontal wires 10*a* arranged in parallel with each other as a basic pattern, and several (three in this embodiment) vertical wires 10*b* which cross the horizontal wires. The horizontal and vertical wires 10*a* and 10*b* are each constituted of a very thin, narrow, strip conductor. The right and left ends of the defogger 10 are constituted of their respective bus bars 10*d* and 10*c* of strip conductors each of which is slightly wider than each of the wires, and they are connected in common to the horizontal wires.

The defogger 10 therefore has a mesh pattern including a number of meshes (openings) as shown in FIG. 1. The mesh pattern is so formed that the length Lx of a longer side of each mesh is set considerably smaller than the wavelength (1 m or more) of a VHF band, e.g., ½ or ⅓ to 1/20 the wavelength. The defogger 10 can thus be considered to be equivalently a single metal thin plate for a received radio wave.

A DC power is applied to the defogger 10 as a heat source from a car-mounted battery 11 through a noise filter 12 (which is constituted of a choke coil and a capacitor as shown) for eliminating high-frequency noise (in the AM band), a DC power source line 13, and a pair of FM choke coils 14A and 14B having a given inductance.

The FM choke coils 14A and 14B separate the DC power source line 13 from both ends of the defogger 10 to render these ends in a high-frequency open state (an open-circuit state).

A non-loop driven antenna 20, which is opened by cutting part (upper central part in FIG. 1) of a rectangular loop, is provided in a region above the defogger 10 or a rectangular region above the window glass surface 110 between the uppermost wire 10U of the defogger 10 and the upper edge portion 120U of a window frame 120. In FIG. 1, reference numeral 20*a* indicates a bottom portion of the antenna 20, and numerals 20*b* and 20*c* denote both open end portions thereof. Like the above defogger 10, the driven antenna 20 is constituted of a very thin, narrow, strip conductor.

The driven antenna 20 is formed very close to the defogger 10. More specifically, the antenna 20 and defogger 10 are opposed to each other with a small clearance CG therebetween in such a manner that one side of the antenna 20 (the bottom portion 20*a*) is mutually coupled to one side of the defogger 10 (the uppermost one 10U of the horizontal wires 10*a*) (coupling index K is approximately 1). In FIG. 1, MC represents a mutually coupling section between the defogger 10 and driven antenna 20.

A feeding section 21 is set in position P, which is slightly shifted to the right from the middle of the bottom portion 20*a* of the driven antenna 20. The feeding section 21 is connected to a receiver set (not shown) through a feeding cable (not shown).

In the vehicle windowpane antenna apparatus so constituted, the entire rear window 100 serves as a slot antenna opening area surrounded with a metal section of the window frame 120 which is considered to be an ideal ground (ground plane). In the AM or FM bands, therefore, the periphery of the defogger 10 functions as a slot antenna SA. The coupling capacitance CM of a mutual coupling section MC of the defogger 10 and driven antenna 20 arranged close to each other, is set equal to or larger than 20 PF (CM≧20 PF). The driven antenna 20 is thus coupled to the slot antenna SA by relatively great force, with the result that their interaction decreases a radiation impedance of the driven antenna 20 or an output impedance. Consequently, the frequency characteristics are flattened within a receiving band and the band is broadened.

Since the feeding section 21 of the driven antenna 20 is located in the position P slightly shifted from the middle of the antenna 20, impedance matching between them is easy to perform.

Since, in the above embodiment, the impedance matching can be performed satisfactorily, most power received by the slot antenna SA is supplied to the receiver set (not shown) such as a radio through the feeding cable (not shown). It is thus thought that the antenna gain of the present antenna apparatus is almost proportional to the area of the whole rear window 100.

As described above, the antenna apparatus of the above embodiment is excellent in that its reception sensitivity (which is proportionate to the antenna gain) almost corresponds to the effective area of the antenna. Since, moreover, the output impedance of the antenna can be lowered and the value Q of the antenna can be decreased, the frequency characteristic is made constant and the frequency band is broadened. For this reason, the tuning operation (adjustment and modification) of the antenna becomes very easy to perform.

Figure 2:
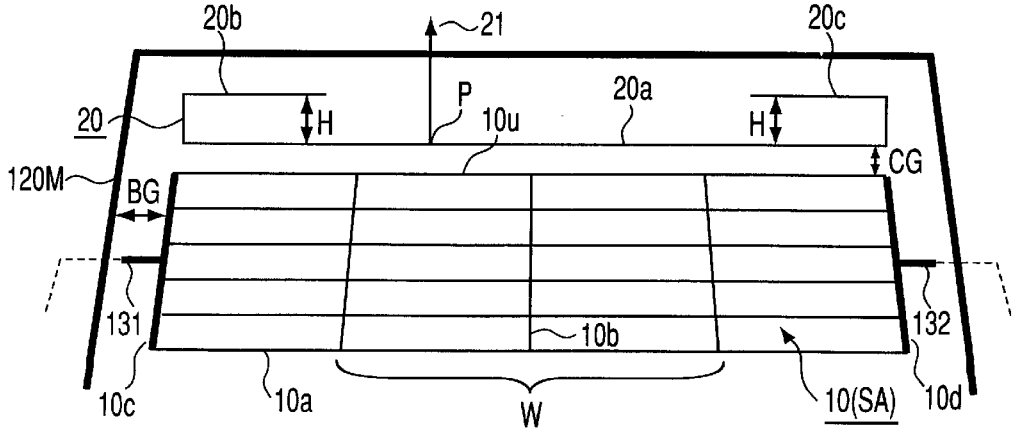
FIG. 2 is a schematic plan view showing both the dimensions of an antenna of the antenna apparatus according to the embodiment of the present invention and the arrangement of the antenna on a rear window.

FIG. 2 is a plan view schematically showing both the dimensions of an antenna of the vehicle windowpane antenna apparatus shown in FIG. 1 and the arrangement of the antenna on the rear window 100. This view is obtained by electromagnetically analyzing a lattice model of the rear window 100 by antenna simulation using an NEC (Numerical Electromagnetic Code) based on an antenna analysis program employing a method of moment as a computational algorithm.

In FIG. 2, BG represents a gap between each of bus bars 10*c* and 10*d*, which are provided at both ends of the defogger 10, and a metal section 120M of the window frame 120. W indicates the number of vertical wires 10*b*. The vertical wires 10*b* constitute the defogger 10 in a mesh pattern such that the defogger 10 can be considered to be equivalently a single metal thin plate for a received radio wave. Moreover, the vertical wires 10*b* are arranged at regular intervals so as to cross the horizontal wires 10*a*. CG represents a gap between one side of the defogger 10 (the uppermost one 10U of the horizontal wires 10*a*) and one side of the driven antenna 20 (the bottom portion 20*a*). H denotes the height of the antenna 20, i.e., the distance between the bottom portion 20*a* and each of the end portions 20*b* and 20*c*.

In FIG. 2, reference numerals 131 and 132 each show a connection circuit for connecting the bus bars 10*c* and 10*d* and the DC power source line 13.

An appropriate mode of each of the respective sections and circuits will be described below.

FIGS. 3 to 8 are diagrams showing characteristics (horizontal surface radiation patterns) of the vehicle windowpane antenna apparatus according to the embodiment of the present invention. The characteristics are obtained on the basis of antenna simulation by the NEC (Numerical Electromagnetic Code).

Figure 3:
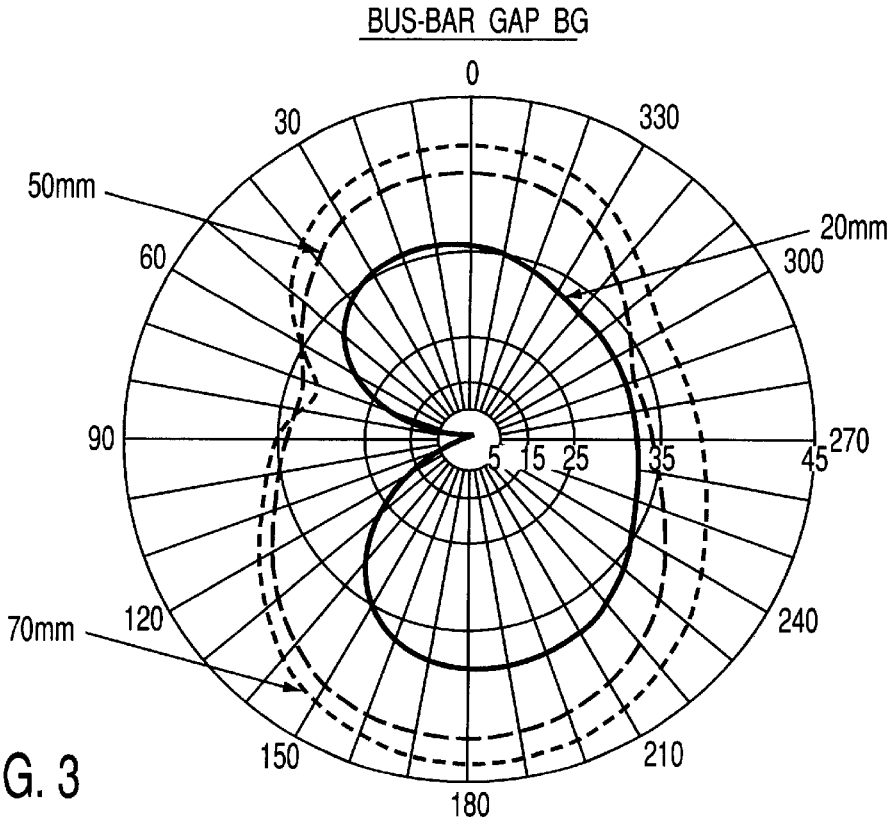
FIG. 3 is a diagram of characteristics of the vehicle windowpane antenna apparatus according to the embodiment of the present invention, showing a horizontal surface radiation pattern using a bus-bar gap BG as parameters.

It is apparent from FIG. 3 that a good radiation pattern can be obtained if the bus-bar gap BG is set to 50 mm or 70 mm. The gap BG can thus be set to about 50 mm.

Figure 4:
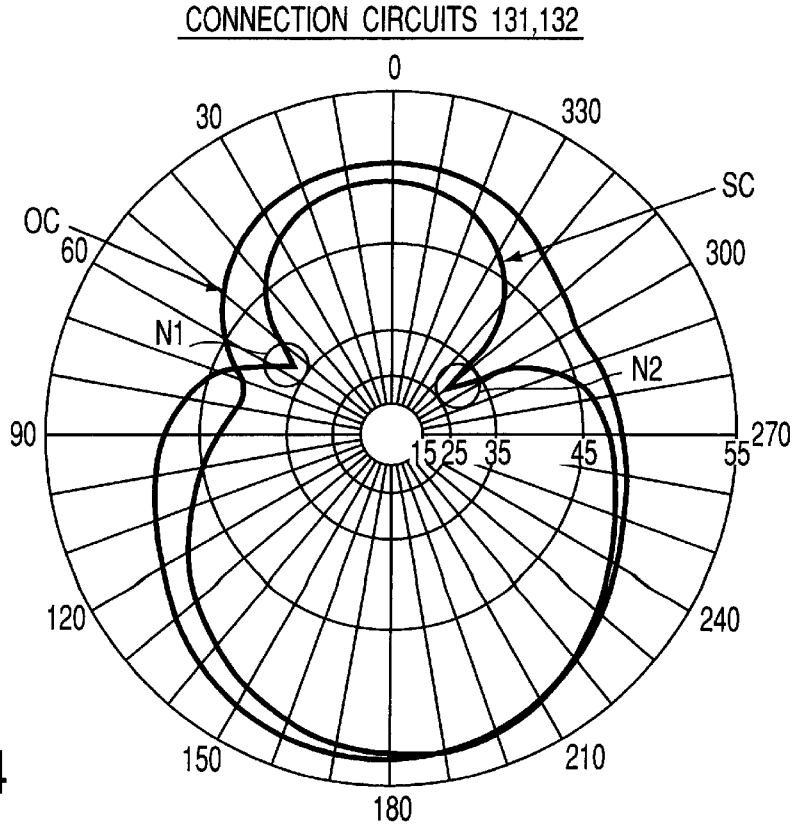
FIG. 4 is a diagram of characteristics of the vehicle windowpane antenna apparatus according to the embodiment of the present invention, showing a horizontal surface radiation pattern using a mode of a connection circuit as parameters.

It is seen from FIG. 4 that it makes no great difference in radiation pattern whether the connection circuits 131 and 132 are each an open circuit OC or a short circuit SC. Since, however, the short circuit SC causes so-called null points N1 and N2 in the radiation pattern, the open circuit OC is said to be favorable.

Figure 5:
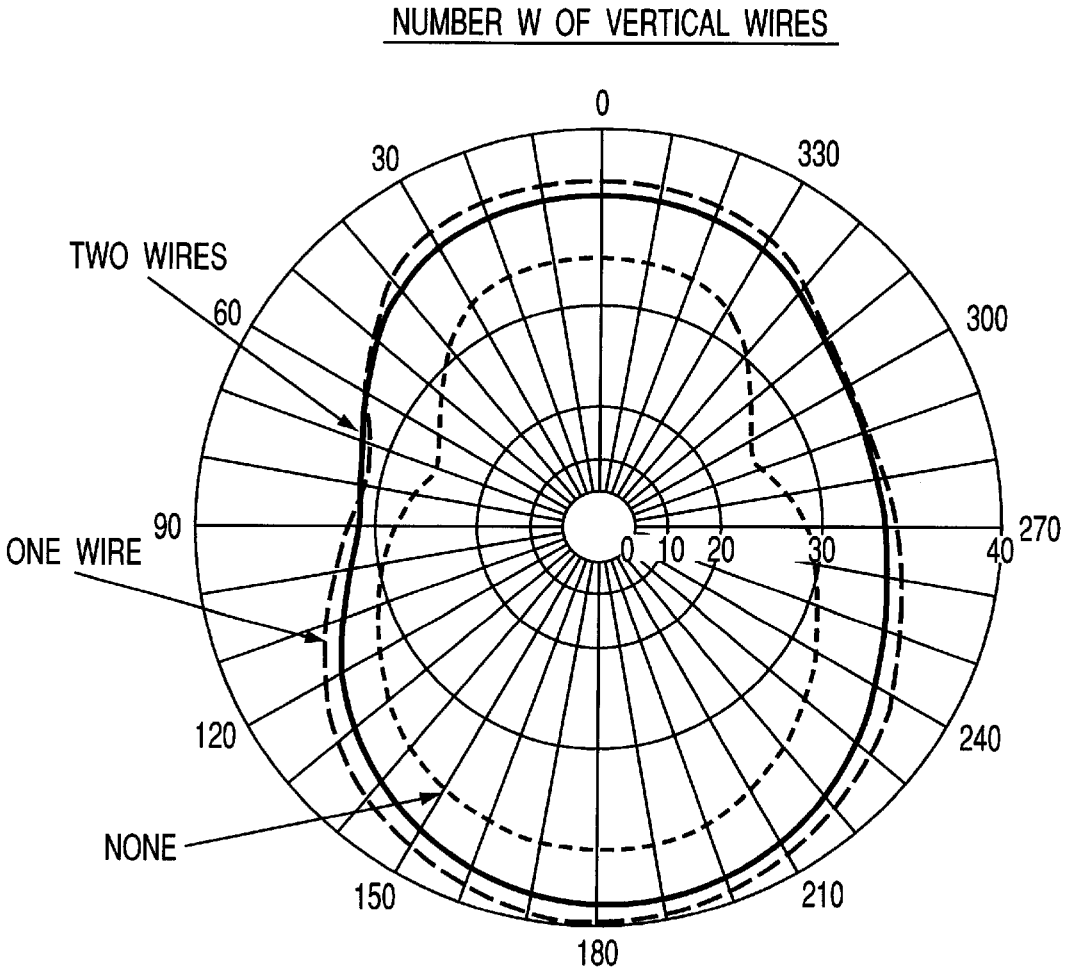
FIG. 5 is a diagram of characteristics of the vehicle windowpane antenna apparatus according to the embodiment of the present invention, showing a horizontal surface radiation pattern using the number W of vertical wires as parameters.

If, as shown in FIG. 5, the number W of vertical wires is larger than 0, e.g., one or two, a radiation pattern becomes good.

Figure 6:
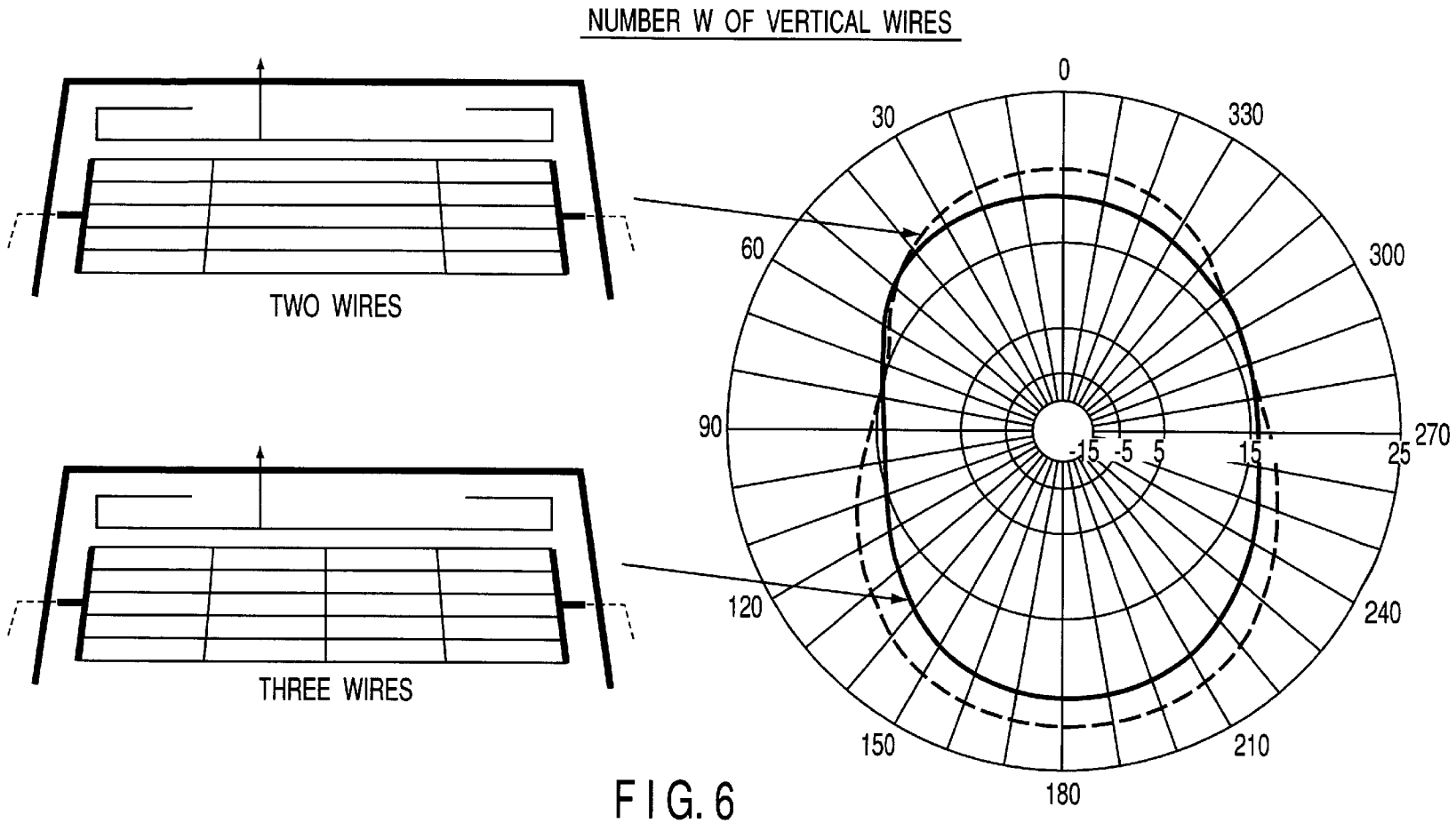
FIG. 6 is a diagram of characteristics of the vehicle windowpane antenna apparatus according to the embodiment of the present invention, showing a contrast between a horizontal surface radiation pattern using two vertical wires and that using three vertical wires.

Furthermore, it is seen from FIG. 6 that it makes no difference whether two vertical wires 10*b* are arranged or three vertical wires 10*b* are arranged at almost regular intervals. It is thus understood from FIGS. 5 and 6 that the number W of vertical wires 10*b* has only to be set to one or more.

Figure 7:
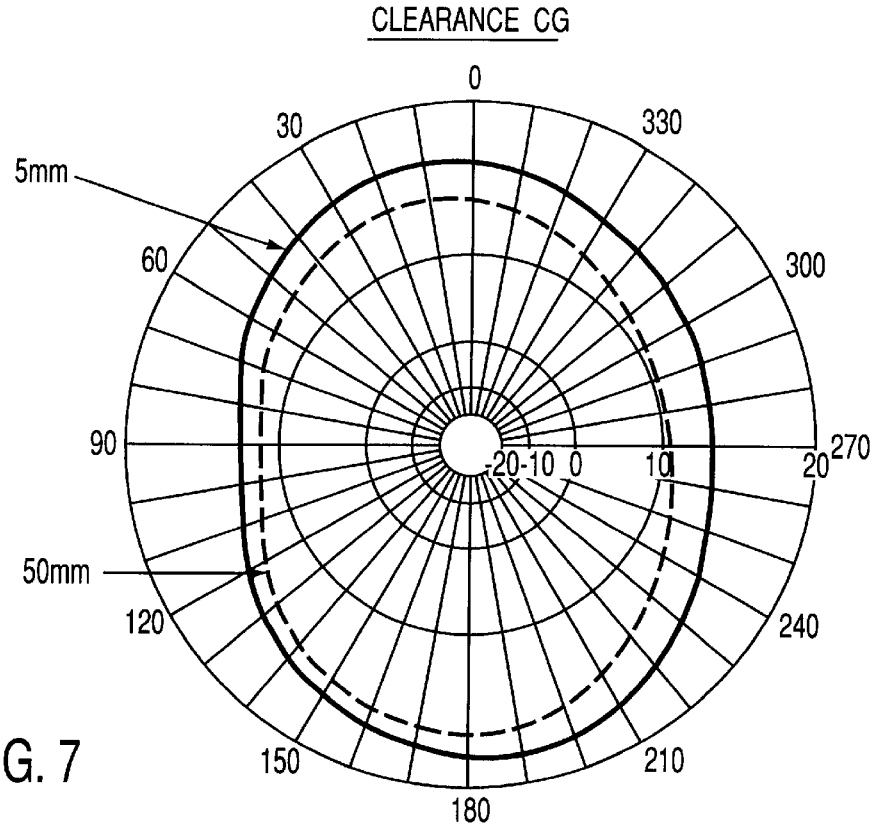
FIG. 7 is a diagram of characteristics of the vehicle windowpane antenna apparatus according to the embodiment of the present invention, showing a horizontal surface radiation pattern using a clearance CG as parameters.

As is apparent from FIG. 7, a good radiation pattern is obtained when a clearance CG between the defogger 10 and driven antenna 20 is set to 5 mm rather than 50 mm. In other words, it is desirable that the clearance CG be as small as possible. Actually, however, it can be said to fall within a range from 5 mm to 15 mm in view of manufacturing technology.

Figure 8:
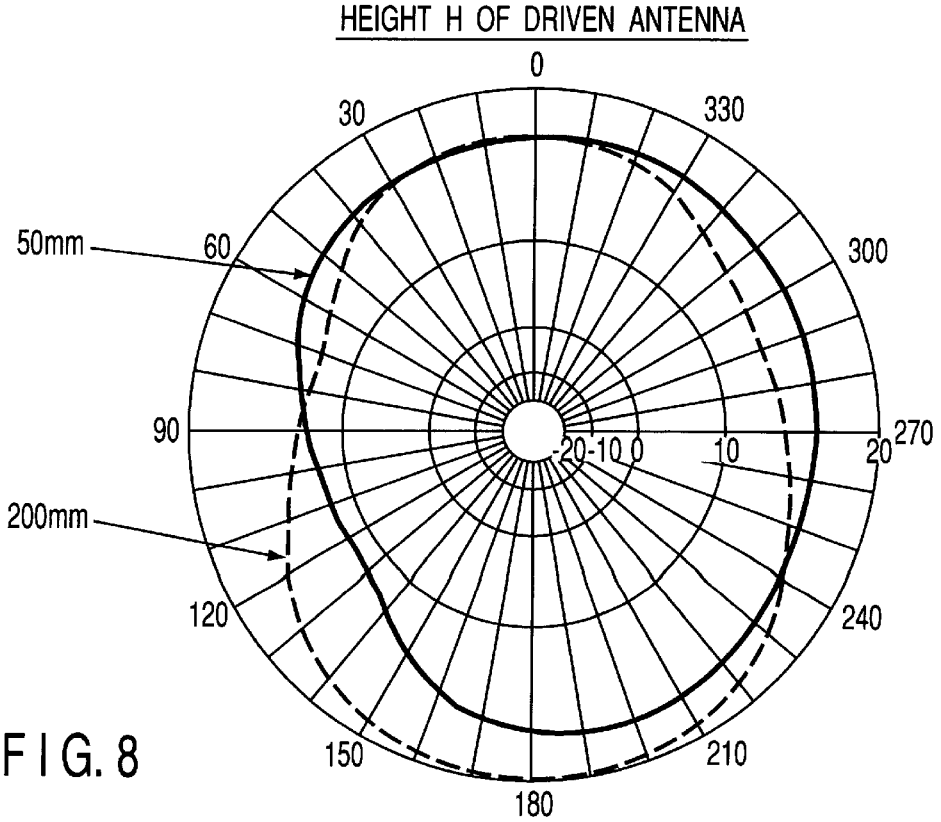
FIG. 8 is a diagram of characteristics of the vehicle windowpane antenna apparatus according to the embodiment of the present invention, showing a horizontal surface radiation pattern using the height H of a driven antenna as parameters.

As is seen from FIG. 8, a good radiation pattern is obtained when the height H of the driven antenna 20 is set to 200 mm rather than 50 mm. It is thus desirable that the height H be as great as possible. Favorably, however, the height H should be set to 100 mm to 250 mm because the driven antenna 20 has to be provided in a limited, small area in the rear window 100.

Features of the Embodiment

[1] A vehicle windowpane antenna apparatus according to the above embodiment comprises:

a defogger (10) for defogging a vehicle window (100), which is constituted of a thin, narrow strip conductor at least including a plurality of horizontal wires (10*a*) arranged in parallel with each other and a pair of bus bars (10*c*, 10*d*) each connected in common to ends of the horizontal wires (10*a*), the bus bars (10*c*, 10*d*) being arranged on a window glass surface (110) of the vehicle window (100) and each opposed to a metal section (120M) of a window frame (120) of the vehicle window (100) with a bus-bar gap (BG) therebetween;

a power source line (13) for applying a power to the defogger (10);

means (14A, 14B) for separating the power source line (13) and the defogger (10) from each other in a high-frequency manner;

vertical wires (10*b*) crossing the horizontal wires (10*a*) to form the defogger (10) in a mesh pattern having meshes, a length (Lx) of a longer side of each of the meshes being smaller than a wavelength of received wave; and a driven antenna (20) having a height (H) and provided close and opposite to the defogger (10) with a clearance (CG) therebetween in such a manner that one side (20*a*) of the driven antenna (20) is mutually coupled (MC) to one side (10U) of the defogger (10), the bus-bar gap (BG) being set to 50 mm to 70 mm, the clearance (CG) being set to 5 mm to 15 mm, the height (H) of the driven antenna (20) being set to 100 mm to 250 mm, the number of vertical wires (10*b*) being one or more, and the power source line (13) and the bus bars (10*c*, 10*d*) constitute an open circuit (OC) therebetween.

In the foregoing vehicle windowpane antenna apparatus, since the periphery of the defogger (10) functions as a slot antenna (SA), and the driven antenna (20) and defogger (10) are mutually coupled to each other, the antenna sensitivity is increased in the FM band, and the frequency band can be broadened within a reception band. A tuning operation of the antenna apparatus is therefore very easy to perform. Even in the AM band, the reception performance (sensitivity) is considerably higher than that of the prior art antenna apparatus. Since, in particular, the dimensions of the antenna and the position thereof on the window glass surface (110) are determined optimally, the antenna apparatus can exactly be mounted on the rear window (100) of an automobile so as to achieve a required antenna characteristic constantly and stably.

[2] In the vehicle windowpane antenna apparatus according to the above item [1], the driven antenna (20) is constituted of a thin, narrow strip conductor.

[3] In the vehicle windowpane antenna apparatus according to the above item [1], the vehicle window is a rear window (100) of an automobile.

Modification

The present invention is not limited to the above embodiment. In the foregoing embodiment, the present invention is directed to an antenna apparatus for receiving radio waves in the AM or FM bands. However, it can be applied to an antenna apparatus for receiving TV waves in the VHF band.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A vehicle windowpane antenna apparatus comprising:

a defogger for defogging a vehicle window, which is constituted of a thin, narrow strip conductor at least including a plurality of horizontal wires arranged in parallel with each other and a pair of bus bars each connected in common to ends of the horizontal wires, the bus bars being arranged on a window glass surface of the vehicle window and each opposed to a metal section of a window frame of the vehicle window with a bus-bar gap therebetween;

a power source line for applying a power to the defogger;

means for separating the power source line and the defogger from each other in a high-frequency manner;

vertical wires crossing the horizontal wires to form the defogger in a mesh pattern having meshes, a length of a longer side of each of the meshes being smaller than a wavelength of received wave; and a driven antenna having a height and provided close and opposite to the defogger with a clearance therebetween in such a manner that one side of the driven antenna is mutually coupled to one side of the defogger, the bus-bar gap being set to 50 mm to 70 mm, the clearance being set to 5 mm to 15 mm, the height of the driven antenna being set to 100 mm to 250 mm, the number of vertical wires being one or more, and the power source line and the bus bars constitute an open circuit therebetween.

2. A vehicle windowpane antenna apparatus according to claim 1, wherein the driven antenna is constituted of a thin, narrow strip conductor.

3. A vehicle windowpane antenna apparatus according to claim 1, wherein the vehicle window is a rear window of an automobile.

* * * * *